United States Patent [19]

Kobayashi

[11] 4,118,605

[45] Oct. 3, 1978

[54] COIL MOUNT STRUCTURE

[75] Inventor: Fumio Kobayashi, Tokyo, Japan

[73] Assignee: Sansui Electric Co., Ltd., Tokyo, Japan

[21] Appl. No.: 867,917

[22] Filed: Jan. 9, 1978

[30] Foreign Application Priority Data

Jan. 19, 1977 [JP] Japan ..... 52-4761

[51] Int. Cl.[2] ..... H04R 9/04

[52] U.S. Cl. ..... 179/115.5 VC

[58] Field of Search ..... 179/115.5 R, 115.5 VC

[56] References Cited

U.S. PATENT DOCUMENTS

| | | | |
|---|---|---|---|
| 1,930,186 | 10/1933 | Swallow | 179/115.5 R |
| 2,013,953 | 9/1935 | Grissinger | 179/115.5 R |

FOREIGN PATENT DOCUMENTS

| | | | |
|---|---|---|---|
| 718,905 | 11/1931 | France | 179/115.5 VC |
| 413,819 | 7/1934 | United Kingdom | 179/115.5 VC |

*Primary Examiner*—George G. Stellar

*Attorney, Agent, or Firm*—Harris, Kern, Wallen & Tinsley

[57] ABSTRACT

A coil mount structure for use in a loudspeaker of moving coil type is disclosed which comprises a generally cylindrical member at around one end portion of which a center peripheral portion of a diaphragm and an inner peripheral edge portion of a damper are removably fixed and at around the other end portion of which a coil is provided.

15 Claims, 6 Drawing Figures

COIL MOUNT STRUCTURE

BACKGROUND OF THE INVENTION

This invention relates to a moving coil type loudspeaker unit and, more particularly, to a coil mount structure of a moving coil type loudspeaker which is easy to assemble and can provide a stable electro-acoustic reproduction characteristic.

In a conventional loudspeaker unit of moving coil type, an example of which is shown in FIG. 1, a magnetic circuit is constituted with a permanent magnet 1 and a center pole 2. A coil bobbin 3 is movably retained. A voice coil 4 is wound around the voice coil bobbin 3 in such a manner that there is provided with an annular magnetic gap 1*a* between a pole piece of the permanent magnet 1 and the voice coil 4. A cone-shaped diaphragm 5 has an inner neck section connected to the voice coil bobbin 3 and an outer circumferential portion adhered to a frame 6 of the loudspeaker unit. A damper 7 has an inner circumferential portion connected to the voice coil bobbin 3 and an outer circumferential portion adhered to a base portion of the frame 6. The aforementioned loudspeaker unit has been assembled in the following manner.

An annular spacer jig is also put coaxially around the center pole 2, and then the voice coil bobbin 3 is inserted into the jig and a yoke on which the frame 6 is mounted is positioned at a desired position with suitable jig. Thereafter, the inner and outer circumferential portions of the damper 7 are adhered to the voice coil bobbin 3 and the base portion of the frame 6 by means of an adhesive agent, respectively as shown in FIG. 2. The inner neck section of the cone-shaped diaphram and the outer circumferential portion thereof are adhered to the voice coil bobbin 3 and the frame 6 by means of the adhesive agent, respectively. Subsequently, the jig is removed and a dust cap 11 is adhered to an upper end portion of the voice coil bobbin 3. Voice coil leads 8 are then connected to a VC terminal 9. All of the above adhesion works must be performed with other suitable jigs.

With such a loudspeaker unit as described above, however, since there is a large number of portions to be adhered by means of the adhesive agent, the adhered portions must be maintained in fixed condition by means of the jigs until these portions are completely adhered. This is disadvantageous in that the assembly thereof requires a large number of jigs and therefore the manufacturing efficiency is low. Therefore, the conventional loudspeaker unit is not suitable to mass produce.

SUMMARY OF THE INVENTION

Accordingly, an object of the present invention is to eliminate the above described drawbacks accompanying conventional loudspeaker units.

More specifically, an object of the present invention is to provide a loudspeaker unit which is high in manufacturing efficiency and mass-productivity and can provide a stable acoustic reproduction characteristics.

The foregoing objects of the present invention are achieved by a provision of an improved coil mount structure by which an inner neck section of a cone-shaped diaphragm and an inner circumferential portion of a damper can be easily connected thereto.

DETAILED DESCRIPTION OF THE PREFERRED EMBODIMENT

Figure 1:
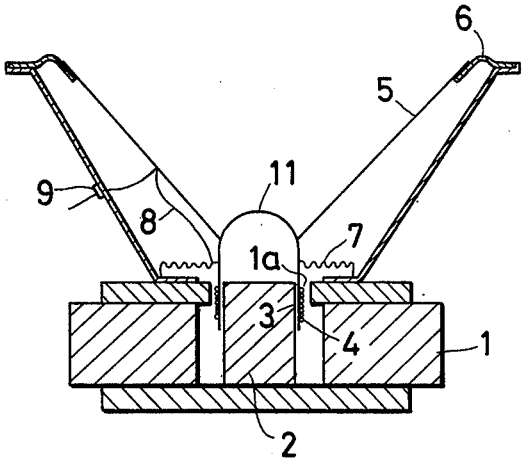
FIG. 1 PRIOR ART
FIGS. 1 and 2 are cross-sectional views of an example of the conventional loud speaker unit and an enlarged illustration of a portion thereof, which are described already.
Figure 2:
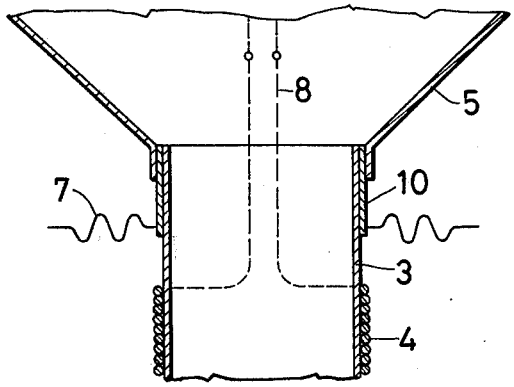
FIG. 2 PRIOR ART
Figure 3:
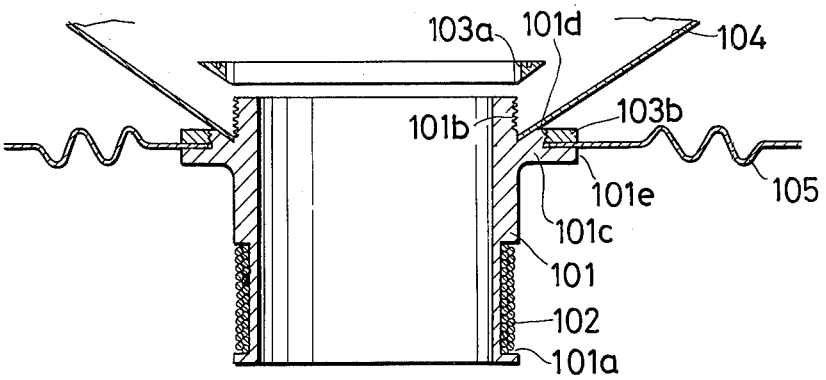
FIG. 3 is a cross-sectional view illustrating an essential part of one embodiment in accordance with the present invention.

In FIG. 3 which shows a cross-sectional view of an embodiment according to the present invention, designated by a reference numeral 101 is a bobbin which may be molded out of a suitable resin. The bobbin 101 is provided on a circumference at its lower portion with a annular groove to receive a voice coil 102 therein. The bobbin 101 is further provided at its upper peripheral portion with threaded portion 101*b* engageable with a nut 103*a*, and a flange 101*c*. An upper surface of the flange 101*c* has a taper suitable to receive an inner neck section of a cone-shaped diaphragm 104 and is shouldered to form a ledge 101*e*. On the shoulder a thread 101*d* is provided. The thread 101*d* is engageable with a nut 103*b*. The inner neck section of the cone-shaped diaphragm 104 is jammed between the tapered surface portion of the flange 101*c* and the nut 103*a* engaged with the threaded portion 101*b*. Similarly, an inner circumferential portion of a damper 105 is jammed between the upper surface of the ledge portion 101*e* and the nut 103*b* engaged with the thread 101*d* of the shoulder of the flange 101*c*. In connecting the diaphragm 104 and the damper 105 to the voice coil bobbin 101, an adhesive agent may further be used in combination. Even in such case, since the diaphragm 104 and the damper 105 are screwed on the flange 101*c* by the nuts 103*a* and 103*b*, respectively, it is unnecessary to use jigs. Accordingly, the cone-shaped diaphragm 104 and the damper 105 can be connected to the voice coil bobbin 101 as an integral assembly in advance. The assembly is then mounted on a frame on which the magnet has been mounted and thereafter the outer peripheries of the diaphragm and the damper may be adhered to the frame. Therefore, the speaker unit can be readily and accurately assembled without requiring jigs and troublesome works, which will contribute to an improvement of the manufacturing efficiency thereof.

In the structure in FIG. 3, the voice coil 102 is provided in the groove 101*a* formed on the bobbin 101. This structure may be modified so that a wiring of a thin lead forming the coil can be easier.

Figure 4:
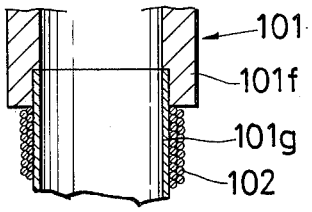
FIG. 4 is a cross-sectional view illustrating an essential part of another embodiment of a voice coil bobbin in accordance with the present invention.

FIG. 4 shows the modification in which a bobbin 101*g* is prepared on which the coil 102 is wound. The outer diameter of the bobbin 101*g* is slightly larger than the inner diameter of the bobbin 101 and the lower end 101*f* of the inner surface of the latter is shouldered to receive the bobbin 101*g* with a suitable adhesive. According to this modification, the coil may be assembled by inserting the bobbin 101*g* into the lower end of the bobbin 101 after all other parts are assembled.

Figure 5:
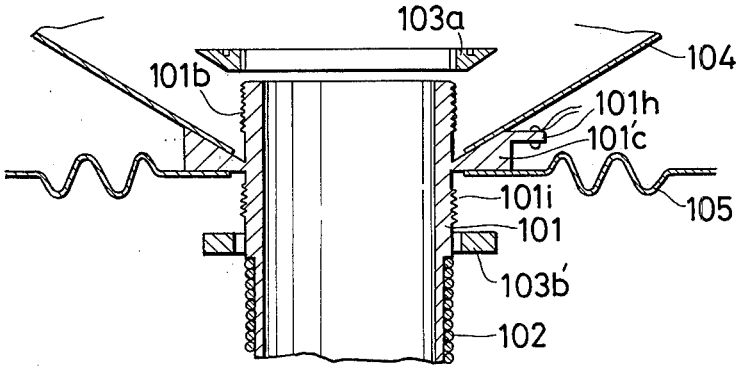
FIG. 5 is a cross-sectional view illustrating an essential part of a further embodiment in accordance with the present invention.

FIG. 5 shows another embodiment of the voice coil bobbin. In FIG. 5, a thread 101*i* is provided below a flange 101'*c* instead of the thread 101*d* in FIG. 3. The inner periphery of the damper is jammed between the lower surface of the flange 101'*c* and a nut 103'*b* to be engaged with the thread 101*i*. In this embodiment, the terminals of the voice coil 102 are precedingly connected to coil terminals on an outer protrusion 101*h* of the flange 101'*c*. In this case, an adhesive agent may also be employed with the nuts 103*a* and 103'*b* in order to ensure their fixation. Upon the above mentioned arrangement, the ends of the voice coil 102 wound about the voice coil bobbin 101 can be precedingly soldered to the terminal 101*h* and thereafter the voice coil bobbin can be united with a frame. As a result, this provides an improved workability.

Figure 6:
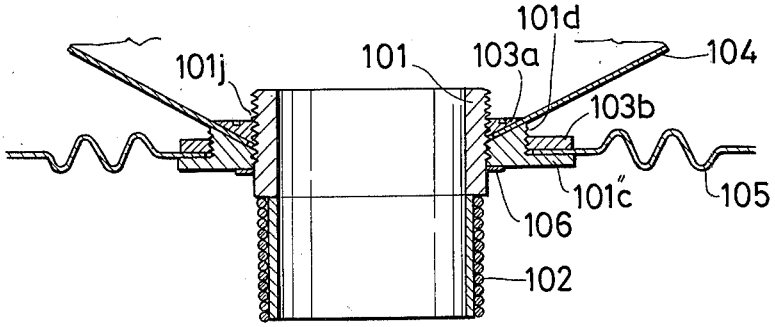
FIG. 6 is a cross-sectional view illustrating an essential part of a still further embodiment in accordance with the present invention.

FIG. 6 shows a still further embodiment of the voice coil bobbin according to the present invention. In FIG. 6, a voice coil bobbin 101 is provided at its upper peripheral portion with a threaded portion 101*j*. An annular ring 101''*c* is provided with an inner thread which is engaged with the threaded portion 101*j* on the bobbin 101 to form a flange of the bobbin 101 the position of which is adjusted. An inner neck section of a cone-shaped diaphragm 104 is jammed between the tapered surface of the flange 101''*c* and a nut 103*a* engaged with the threaded portion 101*j* so as to support the cone-shaped diaphragm as in the previous embodiments. An inner circumferential portion of a damper 105 is jammed between the ledge portion of the flange 101''*c* and a nut 103*b* engaged with a threaded portion of the flange 101''*c* so as to support the damper 105. In this case, in order to ensure a fixation of the cone-shaped diaphragm or the damper, an adhesive agent may be employed with the nuts 103*a* and 103*b* as in the previous embodiments.

Upon the above described arrangement, it is possible to readily position the voice coil bobbin 101 at a desired position, whereby its workability is improved. A stopper 106 may be employed so as to positively retain the flange 101''*c* at a desired position. In addition, in the embodiment in FIG. 6, the provision of the groove for the coil may be substituted by the structure in FIG. 4.

The bobbin with or without flange and other parts of the present invention may be prepared by molding or press process.

As is apparent from the above description, the voice coil bobbin according to the present invention has a superior workability. Accordingly, assemblies of loudspeakers are much simplified. The loudspeaker units thus assembled are stable in reproduction characteristics and is excellent in productivity.

What is claimed is:

1. A coil bobbin assembly for use in a loudspeaker of moving coil type comprising, a generally cylindrical member having one peripheral thread at one end thereof;

an annular member disposed around said peripheral thread to form a collar of said cylindrical member, said annular member having a first surface adapted to receive a neck portion of a cone-shaped diaphragm and a second surface adapted to receive an inner circumferential edge portion of a damper;

a first member to be engaged with said peripheral thread to fix said neck portion of said diaphragm between said first surface and said member;

a second member for fixing said inner circumferential edge portion of said damper to said second surface of said annular member; and a coil mounting means associated with said cylindrical member.

2. A coil bobbin assembly as claimed in claim 1, wherein said second member is engagable with said annular member to fix said inner circumferential edge portion of said damper between said second member and said second surface of said annular member.

3. A coil bobbin assembly as claimed in claim 2, wherein said coil mounting means is an annular groove formed on a circumferential surface of said cylindrical member.

4. A coil bobbin assembly as claimed in claim 2, wherein said mounting means is a cylindrical member fittingly insertable into said generally cylindrical member.

5. A coil bobbin assembly as claimed in claim 1, wherein said annular member is integral with said cylindrical member.

6. A coil bobbin assembly as claimed in claim 5, wherein said mounting means is a cylindrical member fittingly insertable into said generally cylindrical member.

7. A coil bobbin assembly as claimed in claim 5, wherein said coil mounting means is an annular groove formed on a circumferential surface of said cylindrical member.

8. A coil bobbin assembly as claimed in claim 5, wherein said second member is engageable with said generally cylindrical member to fix said inner circumferential edge portion of said damper between said second member and said annular member.

9. A coil bobbin assembly as claimed in claim 1, wherein said annular member is shiftable along an axis of said cylindrical member.

10. A coil bobbin assembly as claimed in claim 9, wherein said mounting means is a cylindrical member fittingly insertable into said generally cylindrical member.

11. A coil bobbin assembly as claimed in claim 9, wherein said second member is engagable with said annular member to fix said inner circumferential edge portion of said damper between said second member and said annular member.

12. A coil bobbin assembly as claimed in claim 9, wherein said coil mounting means is an annular groove formed on a circumferential surface of said cylindrical member.

13. A coil bobbin assembly as claimed in claim 9, wherein said second member is engagable with said annular member to fix said inner circumferential edge portion of said damper between said second member and said second surface of said annular member.

14. A coil bobbin assembly as claimed in claim 13, wherein said mounting means is a cylindrical member fittingly insertable into said generally cylindrical member.

15. A coil bobbin assembly as claimed in claim 13, wherein said coil mounting means is an annular groove formed on a circumferential surface of said cylindrical member.

* * * * *